US005450979A

United States Patent [19]

Servick et al.

[11] Patent Number: 5,450,979

[45] Date of Patent: Sep. 19, 1995

[54] FOOTBALL SHAPED THROWING TOY WITH OTHER USES

[76] Inventors: Steve Servick, 3565 Catalpa Way, Boulder, Colo. 80304; Armin Bantowsky, 4244 Redwood Pl., Boulder, Colo. 80301

[21] Appl. No.: 49,841

[22] Filed: Apr. 19, 1993

[51] Int. Cl.[6] ..... B65D 65/00

[52] U.S. Cl. ..... 220/739; 206/217

[58] Field of Search ..... 220/739, 709, 903, DIG. 13, 220/403; 206/217; D7/606, 607; D3/44

[56] References Cited

U.S. PATENT DOCUMENTS

| | | | |
|---|---|---|---|
| Re. 33,449 | 11/1990 | Martin . | |
| D. 251,284 | 3/1974 | Weaver | D7/76 |
| D. 298,105 | 10/1988 | Lamantia, Jr. | D9/307 |
| D. 308,320 | 6/1990 | Raucci | D7/627 |
| 1,800,990 | 4/1931 | Forrest | 220/DIG. 13 X |
| 3,120,319 | 2/1964 | Buddrus | 220/903 X |
| 3,738,529 | 6/1973 | Rose | 220/85 H |
| 3,779,298 | 12/1973 | Piccirilli | 150/52 R |
| 3,848,766 | 11/1974 | Gantt et al. | 220/903 X |
| 3,884,466 | 5/1975 | MacDonald | 273/65 EC |
| 3,905,511 | 9/1975 | Groendal | 220/90.2 |
| 3,910,328 | 10/1975 | Marcoux | 220/3.1 |
| 4,164,284 | 8/1979 | Witt | 206/217 |
| 4,181,765 | 1/1980 | Harmony | 428/157 |
| 4,194,627 | 3/1980 | Christensen | 206/545 |
| 4,197,890 | 4/1980 | Simko | 383/97 |
| 4,268,567 | 5/1981 | Harmony | 428/195 |
| 4,282,279 | 8/1981 | Strickland | 224/32 R |
| 4,293,015 | 10/1981 | McGough | 220/85 H |
| 4,344,303 | 8/1982 | Kelly, Jr. | 62/530 |
| 4,383,422 | 5/1983 | Gordon | 62/457.4 |
| 4,399,668 | 8/1983 | Williamson | 62/457.4 |
| 4,401,245 | 8/1983 | Zills | 224/148 |
| 4,462,444 | 7/1984 | Larson | 215/100 |
| 4,478,265 | 10/1984 | DeMarco | 220/682 |
| 4,510,665 | 4/1985 | Scheyrer | 29/460 |
| 4,510,769 | 4/1985 | McClellan, Jr. | 62/457.8 |
| 4,517,455 | 5/1985 | Tatsumi | 219/297 |
| 4,540,611 | 9/1985 | Henderson | 428/12 |
| 4,549,410 | 10/1985 | Russell | 62/457.8 |
| 4,561,563 | 12/1985 | Woods | 220/412 |
| 4,583,577 | 4/1986 | Canfield | 150/154 |
| 4,671,424 | 6/1987 | Byrns | 220/408 |
| 4,690,300 | 9/1987 | Woods | 220/412 |
| 4,708,254 | 10/1987 | Byrns | 215/13.1 |
| 4,746,028 | 5/1988 | Bagg | 220/85 H |
| 4,772,020 | 9/1988 | Martin . | |
| 4,802,602 | 2/1989 | Evans | 220/85 H |
| 4,805,799 | 2/1989 | Robbins, III | 220/403 |
| 4,815,999 | 3/1989 | Ayon | 446/73 |
| 4,825,757 | 5/1989 | Stoner | 99/279 |
| 4,872,577 | 10/1989 | Smith | 220/903 X |
| 4,919,422 | 4/1990 | Ma | 273/26 R |
| 4,927,047 | 5/1990 | Stuber | 220/90 |
| 4,960,225 | 10/1990 | Gills | 220/85 H |
| 5,048,734 | 9/1991 | Long | 224/148 |
| 5,067,922 | 11/1991 | McMahon | 446/71 |
| 5,133,550 | 7/1992 | Handy | 273/65 EE |
| 5,152,709 | 8/1992 | Johnson, III | 446/71 |
| 5,169,025 | 12/1992 | Guo | 220/739 |

*Primary Examiner*—Steven M. Pollard

[57] ABSTRACT

A football shaped throwing toy with different embodiments which combine the uses of a throwing toy and a beverage insulating device, a football shaped throwing toy and a container, a football shaped throwing toy and a warming device, a football shaped throwing toy and a cooling device, and a football shaped throwing toy and a container where the container is for the purpose of altering the flight characteristics of the throwing toy.

2 Claims, 3 Drawing Sheets

FOOTBALL SHAPED THROWING TOY WITH OTHER USES

BACKGROUND OF THE INVENTION

1. Field of Invention

This invention relates to the game ball family of inventions, particularly to those having a shape similar to the ball used in American football. American football is a popular game in many parts of the world. The ball used in football was derived from the ball used in the European game of Rugby. The football evolved into a smaller and more pointed version of a Rugby ball. A variety of non-traditional football designs have developed which depart from the traditional or official size, weight and materials of footballs used in organized competitions. These non-traditional designs appeal to players of all ages. Many non-traditional balls are softer, lighter, safer, easier to grip, catch and throw, and some have different flight characteristics than the footballs used in official competitions. U.S. Pat. Nos. 5,133,550 and U.S. Pat. Re. No. 33,449 are examples of non-traditional foam footballs.

This invention also relates to the beverage insulator family of inventions. These inventions are also called insulating holders, beverage jackets, cozies, or coolers. Numerous beverage insulators have been developed and marketed. Many insulators are designed to keep canned or bottled beverages cold, hot beverages hot, and to keep the user's hand from coming in direct contact with condensation, which may form on the outside of cold containers. These beverage insulators have been made of styrofoam, vinyl, polyurethane, foamed polystyrene, other plastics or insulating material. The products have evolved to include designs which have been modified to include lids, latches, handles, clips, carrying straps and pockets. Some designs are adaptable to holding different sizes and shapes of containers. This is accomplished by means such as elastic inserts, stretchable foams, slits and different wrapping and fastening techniques. Some beverage insulators are reusable while others are disposable. Some are collapsible and/or foldable for storage purposes. There are various means of attaching such modifications and various means of producing the product. U.S. Pat. Nos. 4,282,279; 4,746,028; 4,583,577; 4,510,665; 4,478,265; and 4,462,444 are examples.

Closely related to beverage insulators are insulated vacuum bottles, and insulated drinking containers, such as double walled coffee mugs. There are also warming devices, such as U.S. Pat. Nos. 4,517,445 and 4,825,757.

This invention also relates to cooling devices. U.S. Pat. No. 4,344,303, Beverage Container Cooler, Kelly, discusses a cooling device of flexible foam with numerous distinct cavities adjacent to the cooling surface. The cavities are filled with a cooling fluid. U.S. Pat. No. 4,815,999, Insulated Container Having a Three-Dimensional Exterior Caricature, discusses a puppet which has a recess for receiving a beverage container. The puppet is insulated or has a chilled gel therein to cool the container.

U.S. Pat. No. 4,164,284, Liquid Container Novelty, Witt, reveals a container novelty in a predetermined shape. The claims of this patent revealed a football shaped container, with a rigid shell, having complementary interlocking edge portion and said shell having an inturned integrally formed flange portion. The container has a body, neck and cap. Patents D308,320 and D251,284 revealed a football shaped lunch-box and D248,105 a football shaped display container.

None of the inventions mentioned above involve a combination football shaped throwing toy and insulating device, football shaped throwing toy and container, football shaped throwing toy and warming device, or football shaped throwing toy and cooling device. These are objects of this invention.

U.S. Pat. No. 5,067,922, Combination Drink Cooler and Throwing Toy, McMahon, and U.S. Pat. No. 5,152,709, Beverage Insulating Flight Cylinder, Johnson, combine beverage insulators and flight toys. U.S. Pat. No. 5,067,922 is a cylinder device, open at both ends. Similarly, U.S. Pat. No. 5,152,709 is a straight, hollow and longitudinally balanced cylinder, open at both ends, having a leading/lower end and a trailing/-upper end comprised of soft cellular copolymer. However, unlike this invention, these patents are not football shaped.

SUMMARY OF THE INVENTION

In accordance with the invention, we claim the following as our objects and advantages.

An object of the invention is a soft, light, safe, easy to grip, throw and catch football-shaped game ball.

An object of the invention is a football shaped insulating device used for recreation and practicality. Recreation is provided as a throwing toy. Practicality is provided as an insulating device.

Other objects of the invention relating to a Combination Football Shaped Throwing Toy and Insulating Device (CFSTTID) include:

1. A CFSTTID to keep a cold drink cold, a hot drink hot, and to insulate the user from direct contact with condensation which forms on beverage containers.
2. A CFSTTID which can keep foreign objects, such as dirt, dust, sand, and insects from coming in contact with a beverage and its container.
3. A CFSTTID which securely holds a container in place when used as a insulating devise or throwing toy.
4. A CFSTTID advertising medium for use during football game parties. These parties, typically involve consumption of canned or bottled beverages and participation in throwing games, such as flying discs or footballs. The invention provides an apparatus for both activities: insulating and/or containing beverages and providing a throwing toy.
5. A CFSTTID which provides one beverage insulating device per football shaped throwing toy.
6. A CFSTTID which provides two beverage insulating devices per football shaped throwing toy.
7. A CFSTTID which provides more than two beverage insulating devices per football shaped throwing toy.
8. A CFSTTID which can be used to insulate water bottles.
9. A CFSTTID which can be used to insulate bicycle water bottles.
10. A CFSTTID which can be manufactured to fit a variety of drinking container shapes.
11. A CFSTTID which has a means to prevent a vacuum from forming when a container is removed from its secure position within the insulating device.

12. A CFSTTID which is capable of, or adaptable to insulating containers of different sizes and shapes.
13. A CFSTTID in which different means of accessing the liquid container and its contents can be provided. Such access may include, but is not limited to slots, straws, caps, holes or other means.

Another object of the invention is to provide a means of attaching conical shaped ends to existing beverage insulators, in a fashion to produce a football shaped throwing toy.

An object of the invention is to provide a means of attaching conical shaped ends to existing drinking containers, such as cans and bottles, in a fashion to produce a football shaped throwing toy.

An object of the invention is to provide a beverage insulating material which can be formed or wrapped into the shape and use of a football shaped throwing toy.

An object of the invention is a football shaped container used for recreation and practicality. Recreation is provided as a throwing toy. Practicality is provided as a container.

An object of the invention is to provide a football shaped throwing toy, which can be used to contain small items, such as toys, a wallet, keys, coins, candy bars, chips, and the like.

An object of the invention is to provide a holder for the football shaped throwing toy, to hold the football shape and an enclosed beverage in an upright position, when you set the beverage down. The holder could be designed to be contained inside the football shape when not in use.

An object of the invention is to provide football shaped containers with little or no insulating properties which may also be used as throwing toy.

An object of the invention is to provide football shaped insulated vacuum bottles which can be used as a throwing toy.

An object of the invention is to provide football shaped insulated or non-insulated cups or mugs which can be used as a throwing toy.

An object of the invention is to provide a combination football shaped container and decorative key chain attachment.

An object of the invention is to provide a football shaped protective, shock absorbing enclosure for its contents. The recess in the enclosure could be shaped complementary to the intended use, such as containing sunglasses or flashlights.

An object of the invention is to provide a football shaped container with a means to contain and dispense a deodorant for uses such as freshening gymnasium lockers or athletic shoes.

An object of the invention is to provide a football shaped throwing toy and insulating device, which has a exterior shell and a liquid fillable bladder for containing different types of beverages.

An object of the invention is a football shaped throwing toy with a means to cool beverages. An example could be a football shaped body with cavities which are capable of containing cooling fluids. These cavities could be located adjacent to a beverage enclosed within the football shaped body.

An object of the invention is a football shaped throwing toy which contains cooling fluids for the purpose of cooling objects placed adjacent to the throwing toy. It could be used as an ice pack or a means to cool the contents of ice chests.

An object of the invention is to provide a cooling device which can also be used as a football shaped throwing toy.

An object of the invention is a football shaped beverage warmer used for recreation and practicality. Recreation is provided as a throwing toy. Practicality is provided as a beverage warmer.

An object of the invention is to provide a warming device which can also be used as a football shaped throwing toy. The warming device could have uses such as a hand warmer, or heating pad.

An object of the invention is to provide a hollow football shaped throwing toy, in which the flight characteristics of the ball can be altered by inserting different materials or containers into the hollow portion of the ball. Such containers may hold lighter than air gases, other solids or liquids.

An object of the invention is to provide a football shaped insulating device or container and throwing toy in which the flight characteristics of the ball can be altered by the internal construction, internal contents or the exterior shape of the ball.

An object of the invention is a football shaped toy which is suitable for use as a pillow, lower back lumbar support pad or an article with similar use.

An object of the invention is to provide a means for the football shaped throwing toy have a combination of other uses. Uses include a football shaped throwing toy with a attached or enclosed time keeping device, flashlight, key ring or other combinations.

An object of the invention is being able to combine any number of the mentioned or implied objects in combination to form a unique embodiment.

An object of the invention is to provide a hollow football shaped throwing toy and insulating device in which different means of accessing the hollow portion can be manufactured or used. Including such means as hook and loop fastening material, zippers, laces, hinges, latches and caps.

An object of the invention is to provide a football shaped throwing toy with a variety of possible types of parts and location of parts such as pockets, latches, handles, lids, caps, handles, carrying straps, and holders. These parts may be attached in a variety of ways. Ways may include, but are not limited to, hook and loop material, zippers, elastic, laces, hinges, latches, threaded and screw together pieces, snaps, fabrics, cords, sewn material, male-female and other types of joints.

An object of the invention is to provide a football shaped throwing toy which can be manufactured using a number of different types of materials including foams, fabrics, leather, rubber, natural or synthetic materials.

Other objects will be in part obvious and in part pointed out in more detail below. The invention consists in the features of construction, combination of elements, objects and arrangements of parts which will be exemplified in the construction and indicated in the claims.

DESCRIPTION OF DRAWINGS

FIG. 5 shows the front view of the football shape made from panels 8, 9, 10, 11, 12, 13, 14 and 15.

FIG. 7 shows front view of football shape made from panels 16, 17, 18, 19, 20, 21, 22 and 23 along with 24) fastening material.

LISTING OF DRAWING REFERENCE NUMBERS

Figure 1:
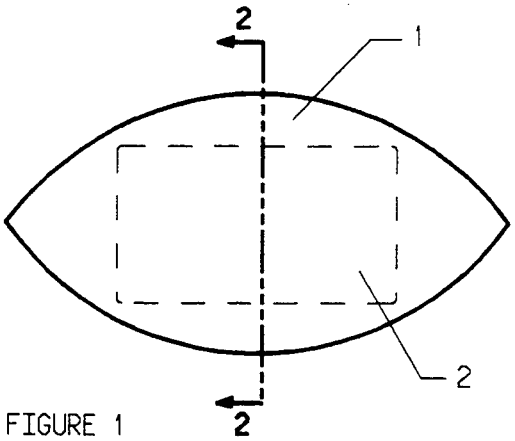
FIG. 1. Front view of the invention showing parts #1) football shape and 2) recess.
Figure 2:
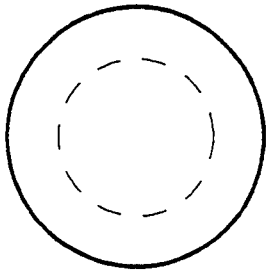
FIG. 2. End view of the invention showing 1) football shape and 2) recess.
Figure 3:
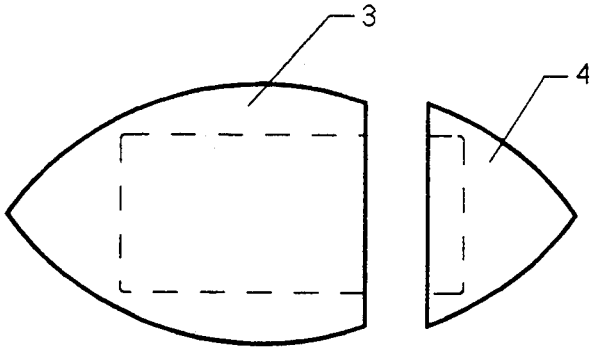
FIG. 3. Front view of an embodiment of the football shape being separated into two parts (3 & 4). Each part has means to insulate a beverage container.
Figure 4:
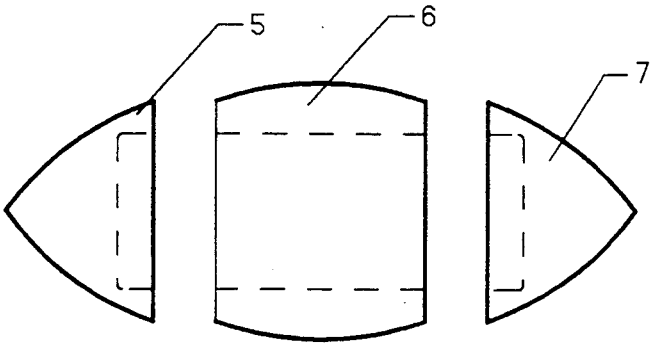
FIG. 4. Front view of an embodiment of the 1) football shape being separated into three parts, 5, 6 & 7. Each part 5, 6 & 7 having means to insulate a beverage container.
Figure 5:
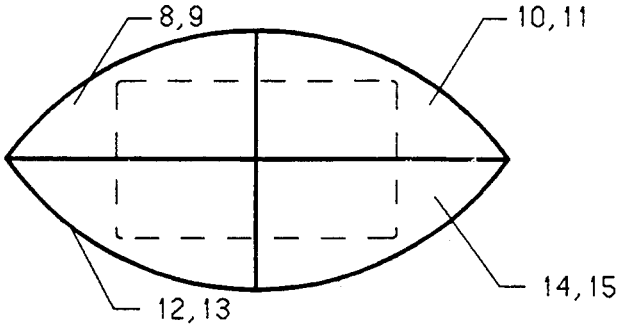
FIG. 5. Example of football shape having means to be adjustable to different sized containers. This is accomplished by having separate panels fastened together. Fastening material is adjustable for stretchable. Panels may also be stretchable.
Figure 6:
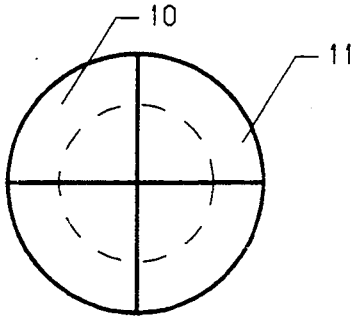
FIG. 6. Shows the end view of FIG. 5.
Figure 7:
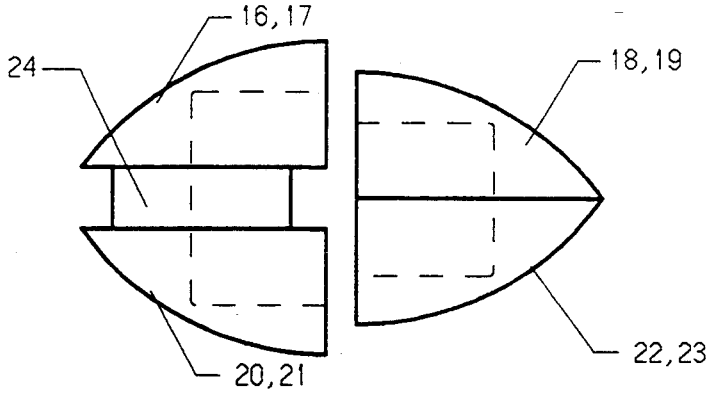
FIG. 7. Example of football shape having means to be adjustable to different sized containers. This is accomplished by having separate panels fastened together. Fastening material is adjustable or stretchable. Panels may also be stretchable.
Figure 8:
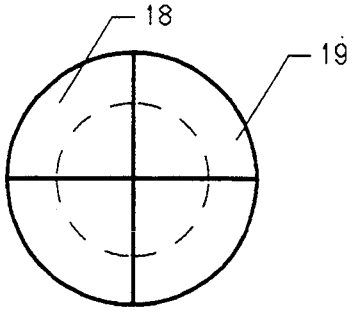
FIG. 8 illustrates the end view of FIG. 7.
Figure 9:
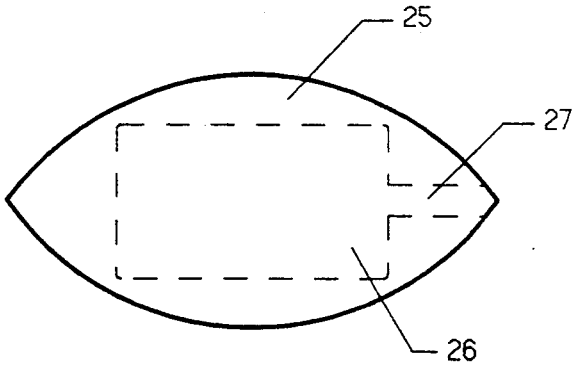
FIG. 9 illustrates an embodiment of a 25) football shape and 26) recess for containing liquids 27) means to fill recess and dispense liquids from the recess.
Figure 10:
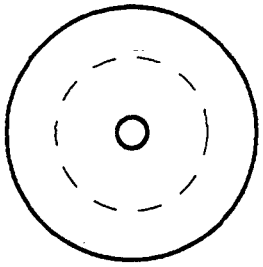
FIG. 10 shows the end view of FIG. 9.
Figure 11:
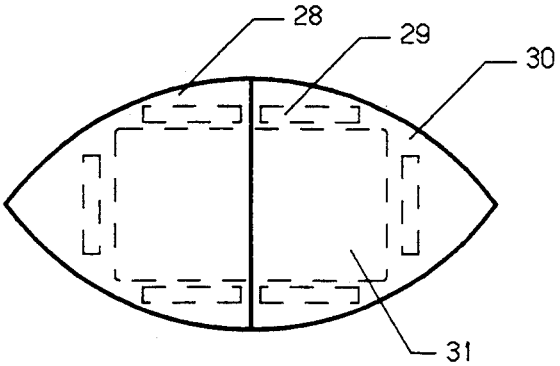
FIG. 11 illustrates the front view of an embodiment of a 30) football shape, 31) recess with cavities (29 & 30) adjacent to the recess. The cavities may contain heating packets or cooling fluid.
Figure 12:
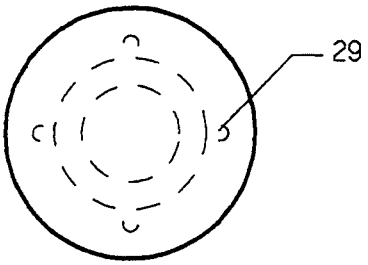
FIG. 12 illustrates the end view of FIG. 11.
Figure 13:
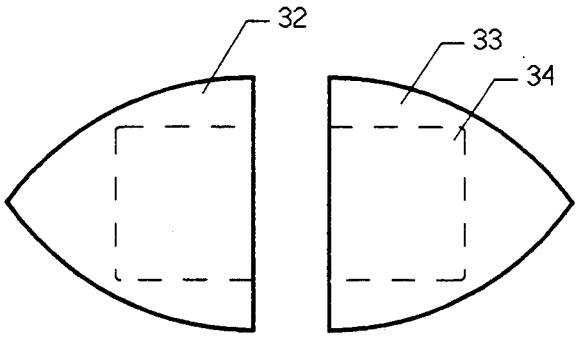
FIG. 13 illustrates 32 & 33) two conical shaped attachments which could be attached to existing containers or beverage insulating devices to form a football shaped throwing toy. 34) Recess is shaped complimentary to existing containers.
Figure 14:
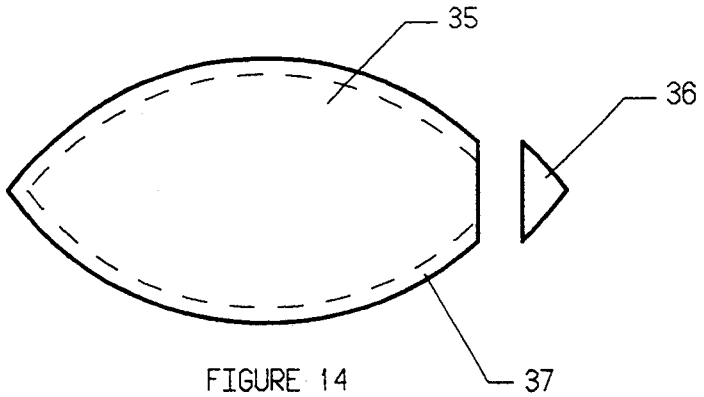
FIG. 14 illustrates a football shaped throwing toy and combination container, comprising parts 37) container 35) recess and 36) a cap.
Figure 15:
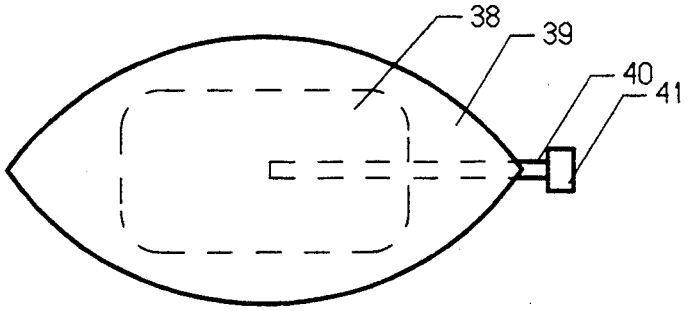
FIG. 15 illustrates a football shaped throwing toy and combination container, comprising parts 39) body, 38) bladder, 40) straw and 41) bladder cap.
Figure 16:
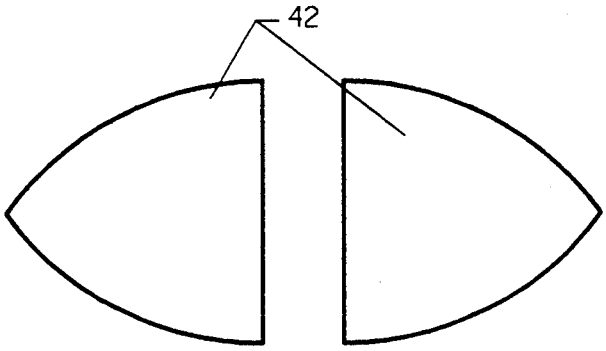
FIG. 16 illustrates a 42) plastic drinking cup which fastens together to form a football shaped throwing toy.
Figure 17:
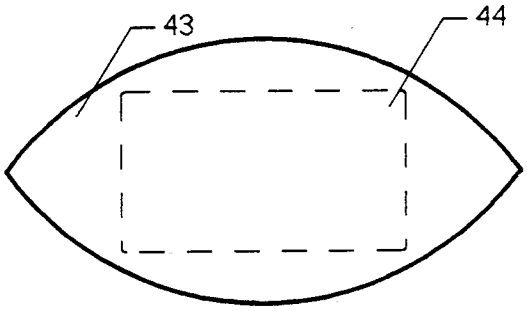
FIG. 17 illustrates the front view of a football with means to alter its flight characteristics. Part 43) is the body and 45) is a container which is inserted into the football for the purpose of altering the foam footballs flight characteristics. The container could enclose lighter than air gases, other solids or liquids.
Figure 18:
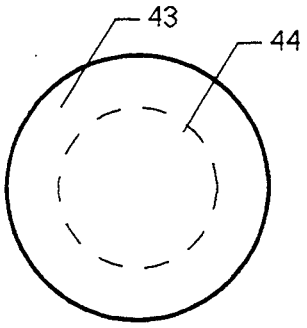

1. Body consisting essentially of a football shape.
2. Recess in the football shape.
3 & 4. Football shape being separated into two parts.
5, 6 & 7. Football shape being separated into three parts.
8, 9, 10, 11, 12, 13, 14, 15. Panels fastened together to form a football shape.
16, 17, 18, 19, 20, 21, 22 & 23. Panels fastened together by stretchable material.
24. Stretchable material which fastens panels 16, 17, 18, 19, 20, 21, 22 & 23 together.
25. Football shape with recess for containing liquids.
26. Recess for containing liquids.
27. Means to fill recess and dispense liquids from the recess.
28. Football shape with cavities adjacent to recess.
29. & 30. Cavities adjacent to recess.
31. Recess in football shape with cavities.
32. & 33. Conical shaped attachments.
34. Recess in conical shaped attachments.
35. Recess in football shaped throwing toy and combination container.
36. Cap.
37. Football shaped container.
38. Bladder.
39. Body of football with a bladder.
40. Straw.
41. Bladder cap.
42. Football shaped plastic drinking cup.
43. Football with means to alter its flight characteristics.
44. Container inserted into football.

PREFERRED EMBODIMENT

The preferred embodiment is that of a combination football shaped throwing toy and insulating device. The interior of the football shaped throwing toy is hollow and complimentary to the shape of the drinking container it is intended for. The construction and shape of the recess is designed to hold the containers securely in place.

Another embodiment is that of a football shaped throwing toy which is also a container of liquid. This may be accomplished by means such as a non-toxic plastic or foam container with a capping device or a foam shell with a non-toxic bladder contained within.

Another embodiment is that of a football shaped throwing toy with means to cool liquids. This may be accomplished by means such as, having cavities filled with cooling gels or fluids adjacent to beverage containers which are enclosed in a football shaped shell.

Another embodiment is that of a football shaped throwing toy with means to warm the contents enclosed within the body of the football shape. This may be accomplished by means such as, having cavities where chemical heat producing packets, heating elements or heatable fluids could be inserted or contained. The packets, fluids or heating elements being adjacent to the contents which are enclosed in the football shaped shell.

Another embodiment is that of a football shaped throwing toy with means to alter its flight characteristics. This may be accomplished by inserting materials, or containers into the hollow section of the body. Containers could enclose lighter than air gases, solids or liquids.

Another embodiment is that of fashioning a football shaped throwing toy by attaching two conical shaped ends to the cylindrical shape of beverage insulating jackets.

Another embodiment is that of fashioning a football shaped throwing toy by attaching two conical shaped ends to existing beverage containers.

Other embodiments may be made by combining elements of the above embodiments into a unique device.

Different types of insulating material, as well as various means to attach the parts may be employed. The invention is not limited to a precise insulating material, means of attachment or bonding method, of the invention herein disclosed, but is to include other alternatives of equivalent functionality within the skill of the art.

The insulating material is one which is able to provide the desired insulating properties, as well as, provide the durability necessary for a throwing toy. Preferred materials include foam polymers, such as closed cell, open cell, rigid types including polyesters, pololefins, polystyrenes, and polyurethanes. Rubber, natural materials or fabrics may also be used.

The means of attaching the component parts may be of hook and loop material such as Velcro TM, hinges, latches, elastic material, threaded screw together pieces, snaps, fabrics, cords, laces, sewn material, male-female and other types of joints and but not limited to zippers.

Bonds may be made using adhesives that are compatible to the materials. Such adhesives are within the skill of the art to be selected.

USE AND OPERATION

A container is removed from its cooling source, such as a refrigerator, and inserted into the football shaped insulator. The insulating device aids in maintaining the temperature of a liquid and preventing the user from direct contact with the condensation on the container. The user may then consume or hold the liquid with increased comfort and utility. Preferably, when the container is removed, the invention can be used as a football shaped throwing toy. Potentially, the invention could still hold a container of liquid or other objects when used as a throwing toy. Depending on safety factors this may be discouraged. However, there is the possibility of contained objects or various designed inserts advantageously altering the flight characteristics of the football shaped throwing toy, thus enhancing its amusement value.

We claim:

1. A multi-functional and repeatedly reusable device comprising a combination game ball and insulated holder for a beverage container and for other articles, and useful for other purposes, said device comprising a generally football-shaped body defining a non-rigid soft foam shell and formed with an internal, chamber-like cavity shaped to removably closely receive a standard beverage can, said body including a generally conical end sector and means for separating said end sector from a remainder of said body for providing access into said cavity of said body, means for reattachment of said end sector to reconstitute said body as a composite unitary structure, said shell providing insulation means for insulating said cavity from an ambient environment, thereby to serve toward perpetuating a given temperature of a beverage container when housed in said cavity, said device comprising, in combination, a throwable toy football, and an insulated chamber-like cavity for a standard beverage can located within said toy football.

2. A multi-functional and repeatedly reusable device comprising a combination game ball and insulated container for liquids and for other articles, and useful for other purposes, said device comprising a generally football-shaped body formed defining a non-rigid soft foam shell and with an internal bladder, said body including a generally conical end sector and means for separating said end sector from a remainder of said body for providing access into said container, means for reattachment of said end sector to reconstitute said body as a composite unitary structure, said shell providing insulation means and for insulating said bladder from an ambient environment, thereby to serve toward perpetuating a given temperature of a liquid when housed in said container, said device comprising, in combination, a throwable toy football, and an insulated container for a beverage.

* * * * *